US005937968A

United States Patent [19]

Gibson et al.

[11] Patent Number: 5,937,968

[45] Date of Patent: Aug. 17, 1999

[54] STEP STOOL

[75] Inventors: William R. Gibson, Kent; Enrique R. Giner, Streetsboro, both of Ohio

[73] Assignee: Cosco, Inc., Columbus, Ind.

[21] Appl. No.: 09/133,833

[22] Filed: Aug. 13, 1998

[51] Int. Cl.[6] ..... E06C 1/00

[52] U.S. Cl. ..... 182/165; 182/129

[58] Field of Search ..... 182/46, 165, 180.1, 182/129; D25/64, 65

[56] References Cited

U.S. PATENT DOCUMENTS

| | | | |
|---|---|---|---|
| 162,075 | 4/1875 | Isaacs et al. . | |
| 1,702,249 | 2/1929 | Davidson | 182/165 |
| 2,109,886 | 3/1938 | Lewis . | |
| 2,207,923 | 7/1940 | Kelso . | |
| 2,525,104 | 10/1950 | Cyr | 182/165 X |
| 2,596,521 | 5/1952 | Bell . | |
| 3,999,629 | 12/1976 | Schaffer et al. . | |
| 4,485,892 | 12/1984 | Maloney et al. | 182/161 |
| 4,502,564 | 3/1985 | Kummerlin et al. | 182/165 X |
| 5,064,243 | 11/1991 | Quain . | |
| 5,419,409 | 5/1995 | Corulla . | |
| 5,722,507 | 3/1998 | Kain | 182/165 X |
| 5,762,163 | 6/1998 | Kain . | |

OTHER PUBLICATIONS

11–135 Two Step™ Folding Step Stool, Cosco® A Dorel Company, Home Furnishings, 1996, p. 17.

11–302 Big Step™ Folding Step Stool and 11–307 Deluxe Big Step™ Folding Step Stool/Chair, Cosco® A Dorel Company, Home Furnishings, 1996, p. 18.

*Primary Examiner*—Daniel P. Stodola
*Assistant Examiner*—Hugh B. Thompson
*Attorney, Agent, or Firm*—Barnes & Thornburg

[57] ABSTRACT

A step stool includes a frame with a front leg and a rear leg pivotably coupled to the front leg for movement of the frame between an opened position and a collapsed position. The front leg includes opposite leg members, a handle portion extending between the leg members, and a step spaced-apart from the handle portion. In addition, the step stool includes a latch movably coupled to the handle portion. The latch is formed to engage the rear leg to block movement of the frame from the opened position toward the collapsed position.

31 Claims, 4 Drawing Sheets

STEP STOOL

BACKGROUND AND SUMMARY OF THE INVENTION

The present invention relates to a step stool, and particularly, to a folding step stool having legs that fold between an opened use position and a collapsed storage position. More particularly, the present invention relates to a folding step stool having a plastic a front leg and a back leg and a latch movably mounted in a handle of the front leg.

Step stools having legs that fold between opened and collapsed positions are known. See, for example, U.S. Pat. Nos. 4,485,892 to Maloney et al.; U.S. Pat. No. 3,999,629 to Schaffer et al.; U.S. Pat. No. 2,109,886 to Lewis; and U.S. Pat. No. 1,702,249 to Davidson, each of which show examples of such step stools.

According to the present invention, a step stool includes a frame that has a front leg and a rear leg and a latch movably coupled to the front leg. The rear leg is coupled to the front leg for pivotal movement between an opened position in which a bottom portion of the front leg is spaced apart from a bottom portion of the rear leg and a collapsed position in which the front and rear legs are folded together.

The front leg of the step stool includes opposite leg members, a handle portion extending between the leg members, and a step spaced-apart from the handle portion. The rear leg of the step stool includes opposite rear leg members each including an elbow pivotably coupled to the front leg so that the frame moves between the opened and closed positions.

In preferred embodiments, the latch is coupled to the handle portion of the front leg. The latch engages the rear leg when the frame is in the opened position to block pivoting movement of the frame from the opened position toward the collapsed position. In addition, the rear leg includes a cross strut extending between the rear leg members. The cross strut supports the step when the frame is in the opened position.

Additional features and advantages of the present invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
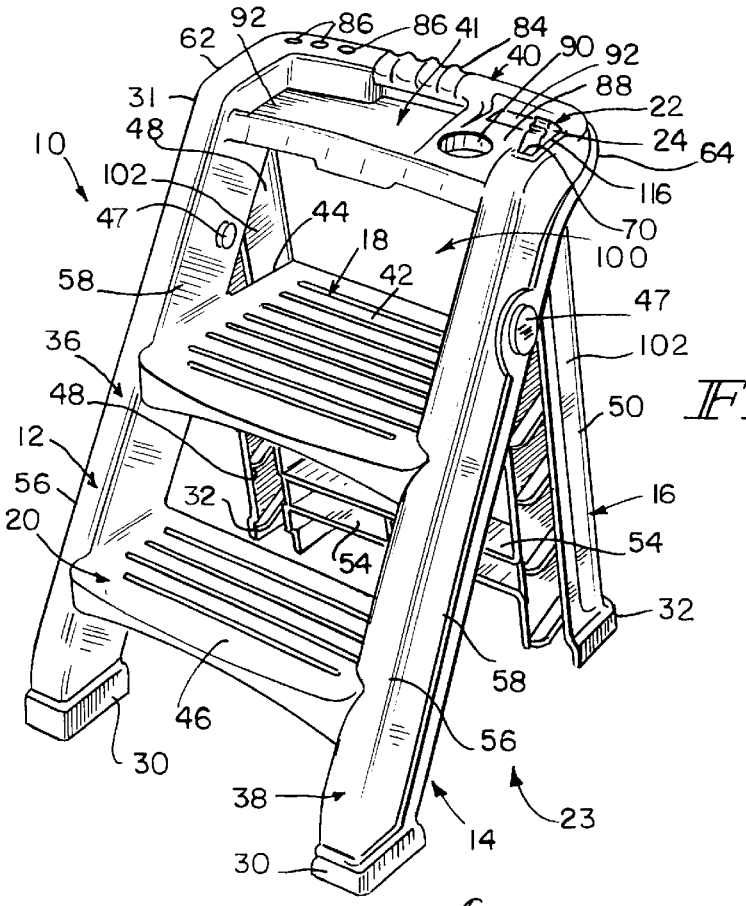
FIG. 1 is a perspective view of a step stool in accordance with the present invention showing front and rear legs of the step stool in an opened position, a top step coupled to the front leg and extending into the rear leg, a bottom step coupled to the front leg beneath the top step, a utility tray coupled to the front leg above the top step, and a latch pivotably coupled to the front leg adjacent to the utility tray.

A foldable plastic step stool 10 is provided accordance with the present invention. As shown in FIG. 1, step stool 10 includes a frame 12 having a front leg 14 and a rear leg 16 and a latch 22 formed to permit pivoting movement between front and rear legs 14, 16. Latch 22 is coupled to front leg 14 for easy access by a user standing in front of step stool 10 without having to walk around step stool 10 and without having to manipulate a number of different mechanisms of step stool 10.

Figure 5:
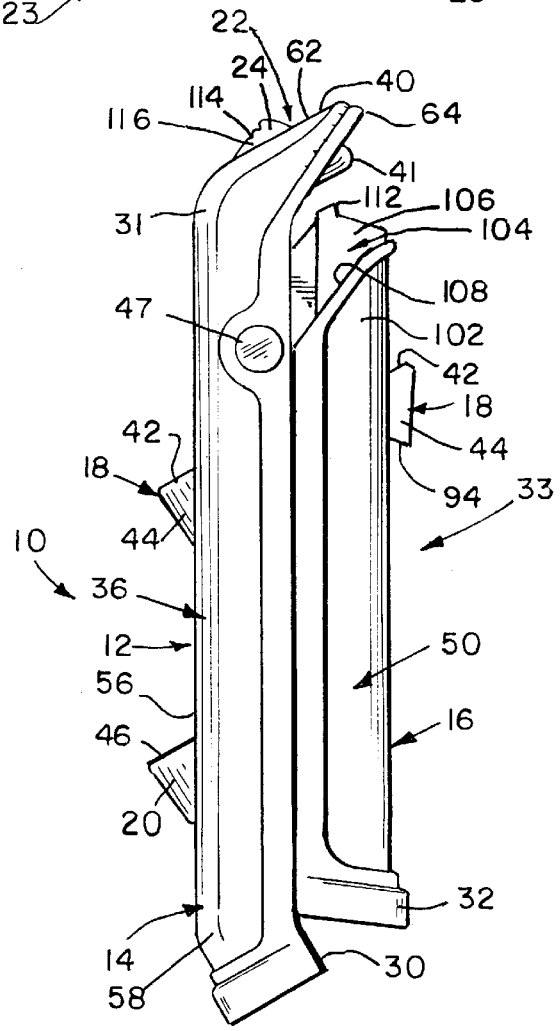
FIG. 5 is right side elevational view of the step stool of FIG. 1 in a collapsed storage position showing the top step extending through the rear leg members and one rear leg member including a post portion and an elbow having a locking tab thereon.
Figure 8:
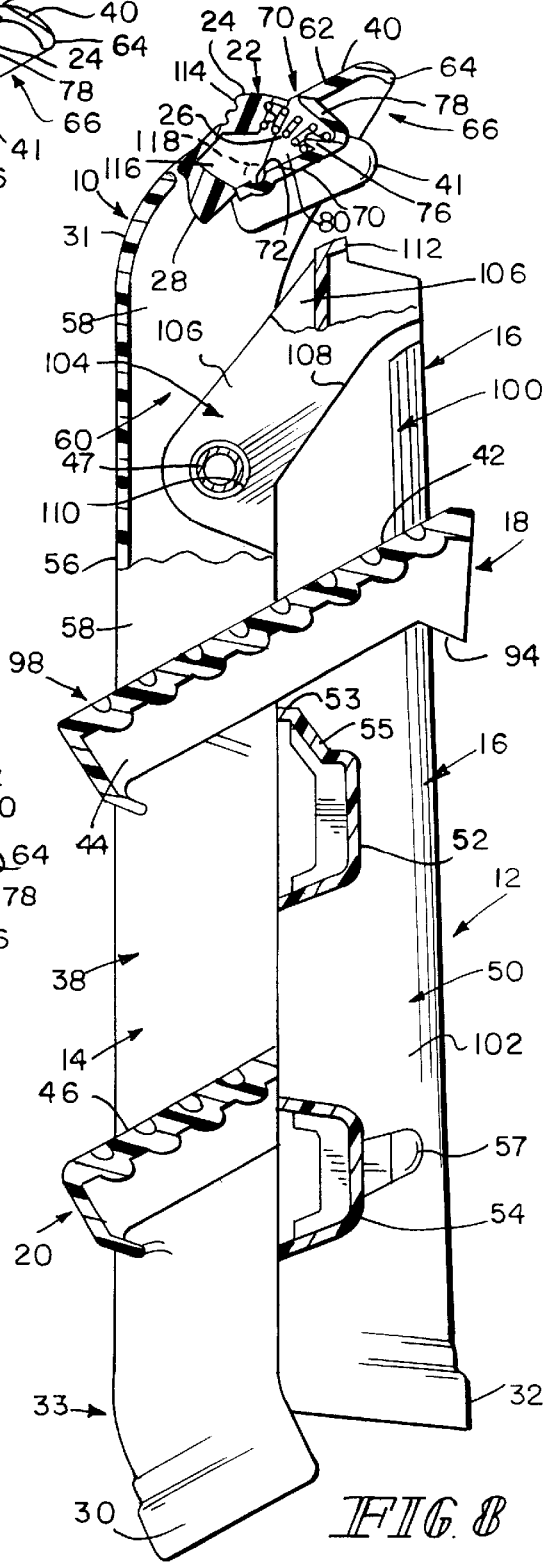
FIG. 8 is a view similar to FIG. 6 of the step stool in the collapsed storage position showing the latch positioned in the normal-fastened position and the elbow of the rear leg member spaced-apart from the latch.

Frame 12 of step stool 10 is foldable between an opened position 23, shown in FIG. 1, in which a bottom end 30 of front leg 14 is spaced apart from a bottom end 32 of rear leg 16 and a closed or collapsed position 33, as shown in FIGS. 5 and 8, in which front and rear legs 14, 16 are folded together. Frame 12 is converted easily between opened position 23 and the collapsed position 33 by depressing latch 22 manually and moving front leg 14 to a generally vertical position as shown in FIG. 5. In response to gravity, rear leg 16 automatically pivots toward front leg 14 causing step stool 10 to assume collapsed position 33.

As shown in FIG. 1, front leg 14 of frame 12 includes opposite leg members 36, 38 each including bottom end 30 and an opposite top end 31, a cantilevered handle portion 40 extending between leg members 36, 38, a top step 18, a bottom step 20, and a utility tray 41 adjacent to handle portion 40. While front and rear legs 14, 16 of frame 12 are preferably constructed of an injection molded plastic, it is understood that a wide variety of materials and molding techniques may be used.

Figure 4:
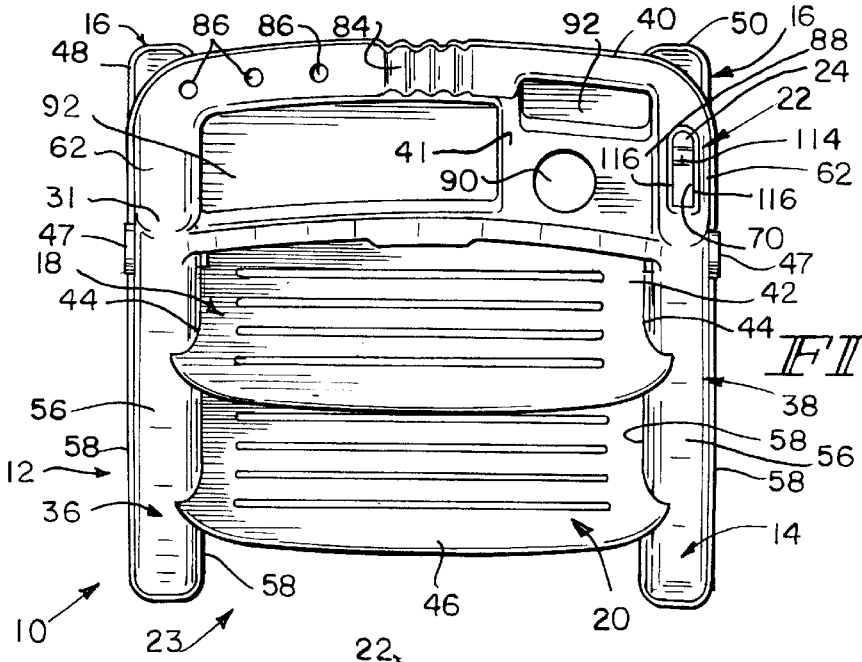
FIG. 4 is a top plan view of the step stool of FIG. 1 showing the front leg including two leg members and showing the handle portion extending between the leg members.
Figure 6:
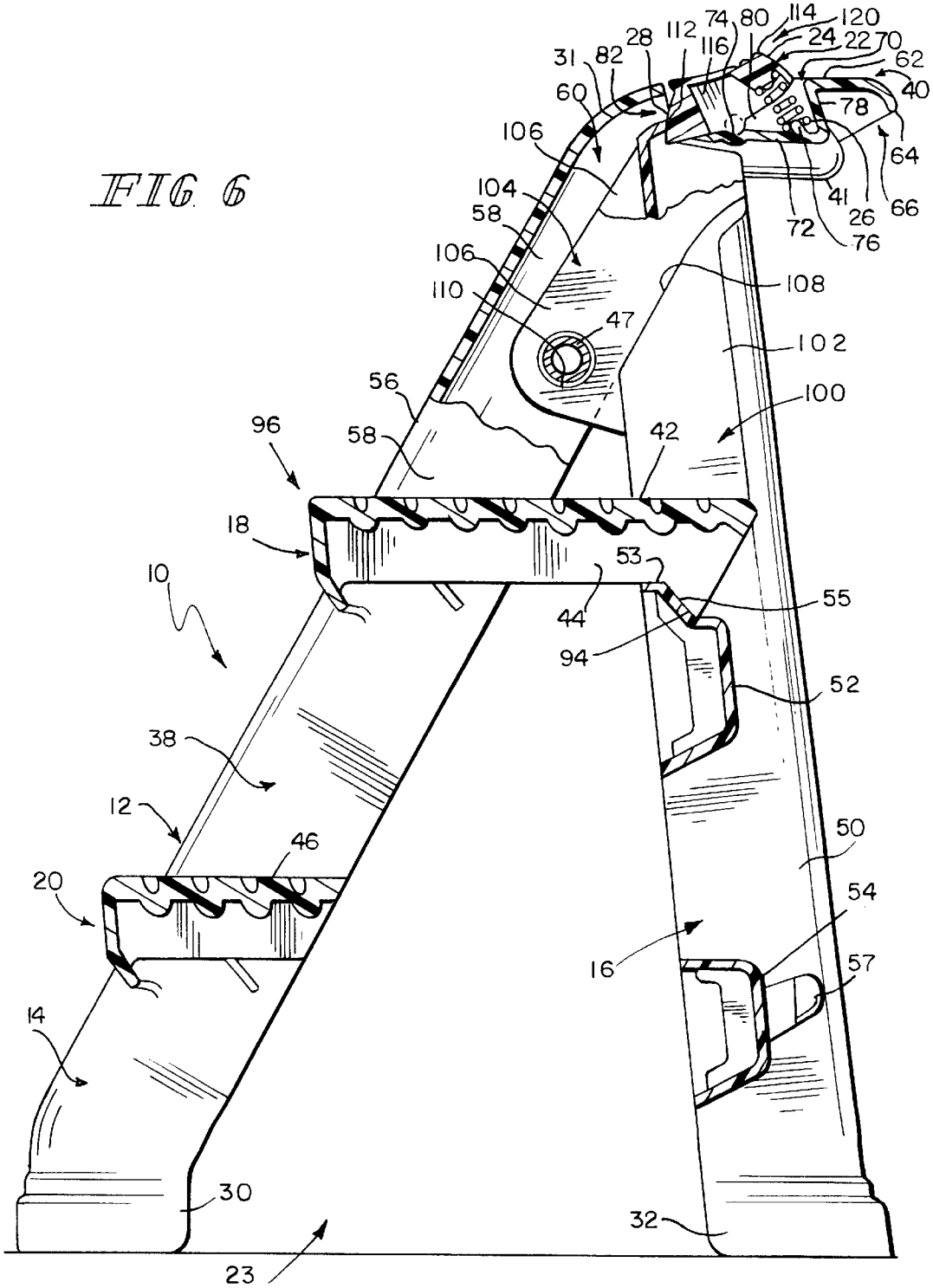
FIG. 6 is a view taken along lines 6—6 of FIG. 2 showing the latch positioned to lie in a normal-fastened position and showing the latch engaging the locking tab in order to prevent the rear leg from pivoting toward the front leg and the collapsed storage position.

Leg members 36, 38 of front leg 14 include a front surface 56 and side walls 58 extending from front surface 56 to define a generally U-shaped channel 60, as shown for example in FIGS. 6–9. As shown in FIG. 6, handle portion 40 includes a top surface 62 extending from front surface 56 of leg members 36, 38 and a lip 64 extending from top surface 62 to define a channel 66 sized to receive fingers 68 from a user gripping step stool 10. As shown in FIG. 4, a hand grip 84 extends through top surface 62 and lip 64. In addition, top surface 62 includes spaced-apart apertures 86 therethrough that are sized to receive tool shafts (not shown).

Handle portion 40 of frame 12, as shown in FIG. 6, is also formed to include a cavity 70 that receives latch 22. Cavity 70 extends through top surface 62 and is defined by a floor 72 supporting latch 22, an end wall 78, and opposing side walls 80 extending between top surface 62 and floor 72. Side walls 80 define an aperture 82 therebetween opposite end wall 78. Latch 22 extends through aperture 82 and engages rear leg 16 when frame 12 is in opened position 23. In addition, floor 72 includes a notch 74 therein and a spring mount 76, as will be discussed hereafter.

Referring now to FIG. 1, utility tray 41 lies adjacent to handle portion 40 of frame 12 to provide easy access for a user. Utility tray 41 includes a tray surface 88 formed to include a passageway 90 sized to receive a portion of a hand-held drill (not shown) therethrough and compartments 92 that have depths sized to receive nuts, bolts, screws, pens, rulers, and the like therein. It is understood that utility tray 41 may include a wide variety of apertures and compartments, or may be formed as a generally flat surface. It is also understood, that step stool 10 may be formed without a utility tray 41.

Figure 2:
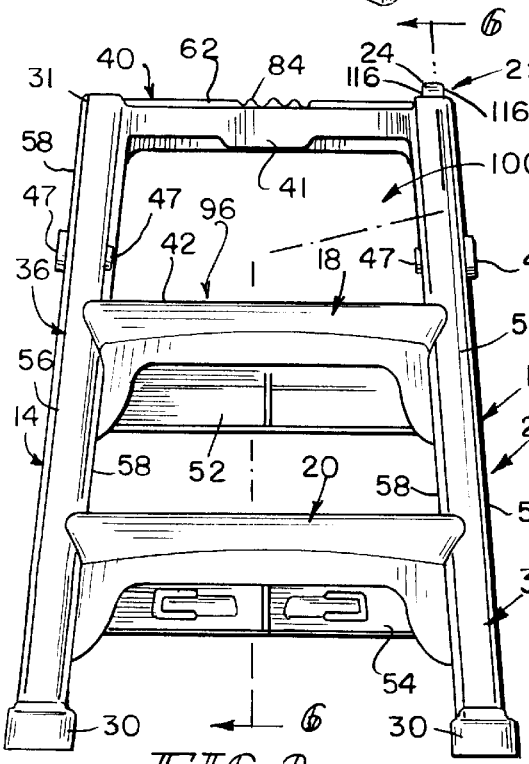
FIG. 2 is a front elevational view of the step stool of FIG. 1 showing pivot pins extending through the front leg, the rear leg including rear leg members, an upper cross strut coupled to the rear leg members and engaging the top step, and a lower cross strut coupled to the rear leg members beneath the upper cross strut.

As shown in FIG. 2, top and bottom steps 18, 20 of frame 12 extend between side walls 58 of leg members 36, 38 spaced-apart from utility tray 41. Specifically, top step 18 is positioned to lie spaced-apart from handle portion 40 and bottom step 20 is positioned to lie between top step 18 and bottom end 30 of front leg 14. Referring now to FIG. 6, top step 18 includes a step surface 42 and support panels 44 extending from step surface 42 toward end 30. Support panels 44 are formed to include a tab 94 extending away from step surface 42. Support panel 44 rests upon rear leg 16 when frame 12 is in opened position 23. In addition, bottom step 20 includes a step surface 46 facing top step 18.

Figure 3:
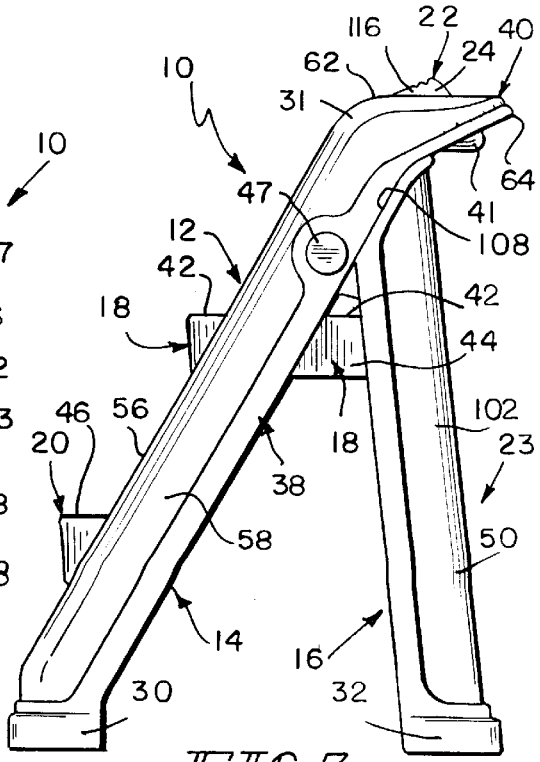
FIG. 3 is a right side elevational view of the step stool of FIG. 1 showing the front leg including a leg member and a handle portion and the latch extending from the handle portion.

Top and bottom steps 18, 20 extend rigidly from front leg members 36, 38 so that step surfaces 42, 44 maintain a constant orientation relative to front leg 14 as frame 12 is moved between the opened and collapsed positions 23, 33. Although the preferred step stool 10, shown in FIGS. 1–3, includes only one bottom step 20 beneath top step 18, it is within the scope of the disclosure for additional steps that are similar to bottom step 20 to be coupled to front leg 14 above and/or below top step 18.

Referring now to FIGS. 1 and 2, rear leg 16 of frame 12 is coupled to front leg 14 by pivot pin 47. Pivot pin 47 snaps through front and rear legs 14, 16, although a wide variety of pins, rods, and the like may be used. Rear leg 16 includes first and second rear leg members 48, 50, an upper cross strut 52, and a lower cross strut 54 having tabs 57 sized to receive an extension cord (not shown). Cross struts 52, 54 extend between rear leg members 48, 50. Referring now to FIG. 6, upper cross strut 52 includes a support portion 53 and a ramped portion 55. Support portion 53 is configured to engage top step 18 when frame 12 is in opened position 23. In addition, ramped portion 55 of upper cross strut 52 engages tab 94 in opened position 23 to block additional pivoting movement of end 32 of rear leg 16 away from end 30 of front leg 14. When frame 12 is in opened position 23, top and bottom steps 18, 20 are in a first position 96 in which step surfaces 42, 46 face upwardly, generally parallel with support portion 53 of upper cross strut 52. As shown in FIG. 8, when step stool 10 is in collapsed position 33, top and bottom step 18, 20 are in a second position 98 in which step surfaces 42, 46 are off-set from support portion 53 of upper cross strut 52. When in second position 98, top step 18 extends through a space 100 defined between upper cross strut 52 and rear leg members 48, 50.

Figure 7:
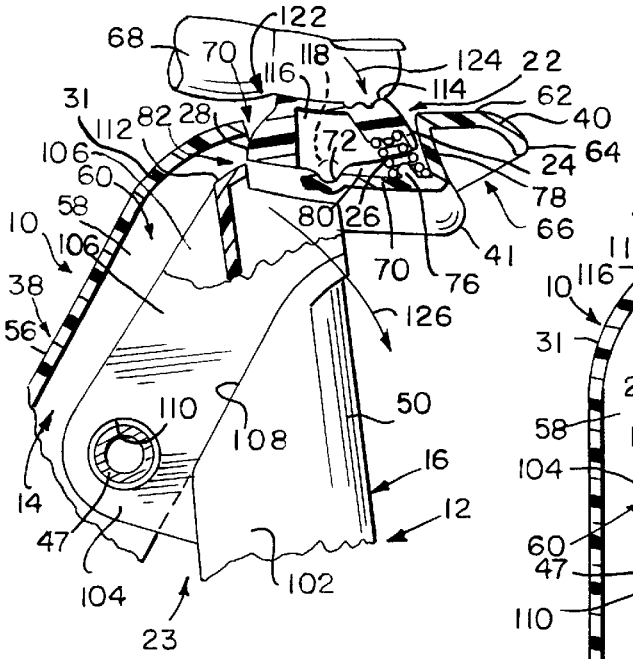
FIG. 7 is an enlarged view of the front leg and the latch similar to FIG. 6 showing manual depression of the latch to a leg-release position to cause movement of the latch away from the locking tab permitting pivoting movement of the elbow under the latch.

Each rear leg member 48, 50, as shown in FIG. 1, includes a post portion 102 supporting cross struts 52, 54 and an elbow 104 extending from post portion 102 and coupled to first leg 14. While second rear leg member 50 will be discussed hereafter, unless otherwise indicated, it is understood that the description applies to first rear leg member 48 as well. As shown in FIG. 7, elbow 104 includes side walls 106 and an edge 108 extending between each side wall 106 and post portion 102. Side walls 106 extend into U-shaped channel 60 and edge 108 engages front leg 14 when frame 12 is in opened position 23, as shown in FIG. 6. Side walls 106 of elbow 104 include an aperture 110 that receives pivot pin 47 therethrough, which permits movement frame 12 between opened position 23 and collapsed position 33. 30 Elbow 104 of second rear leg member 50 further includes a locking tab 112. Locking tab 112 extends away from end 32 and is formed for engagement with latch 22 to couple rear leg 16 and front leg 14 together in opened position 23.

In operation, latch 22 pivots within cavity 70 of front leg 14 and engages locking tab 112 of second rear leg member 50 to couple frame 12 in opened position 23. As shown in FIG. 6, latch includes a push button 24, a spring 26 extending between push button 24 and spring mount 76, and a catch 28 coupled to push button 24. Push button 24 includes a top pad 114 for engaging finger 68 of the user, and side walls 116 extending from top pad 114 into cavity 70. Side walls 116 each include a mounting post 118 that is received in notch 74 of floor 72 and a post-mount (not shown) in side walls 80 to couple latch 22 to front leg 14. Latch 22 pivots on mounting post 118 between a normal-fastened position 120, as shown in FIG. 6, and a leg-release position 122, as shown in FIG. 7. Spring 26 biases latch 22 to normal-fastened position 120, in which push button 24 is biased through cavity 70 away from floor 72 for access by the user and catch 28 is biased through aperture 82. While latch 22 is illustrated and described, it is understood, that a wide variety of coupling mechanisms may be used. Latch 22 may slide rather than pivot relative to front leg 14.

As shown in FIG. 6, when frame 12 is in opened position 23 and latch 22 is in normal-fastened position 120, catch 28 extends downwardly from handle portion 40 and engages locking tab 112. Thus, rear leg 16 is prevented from pivoting toward front leg 14. In addition, support panel 44 of top step 18 rests upon support portion 53 of upper cross strut 52 of rear leg 16 and tab 94 engages ramped portion 55 to prevent rear leg 16 from pivoting away from front leg 14. Edge 108 also engages front leg 14 to block further pivoting movement of rear leg 16.

To fold frame 12 of step stool 10 from opened position 23 to collapsed position 33, the user presses top pad 114 of push button 24 toward floor 72 of cavity 70 as shown by arrow 124 in FIG. 7. At this time, catch 28 pivots toward top surface 62 of handle portion 40 and away from locking tab 112. Thus, as shown by arrow 126, elbow 104 is free to pivot in a generally clock-wise direction moving locking tab 112 under latch 22. Elbow 104 pivots automatically, due to gravity, when the user lifts or tilts front leg 14 to a generally vertical position, as shown in FIG. 8. Rear leg 16 pivots on pivot pin 47 until step stool 10 lies in generally collapsed position 33, as shown in FIG. 8. Front and rear legs 14, 16 may be formed such that, due to friction, rear leg 16 does not pivot automatically, but requires the user to move manually end 32 of rear leg 16 toward end 30 of front leg 14.

Figure 9:
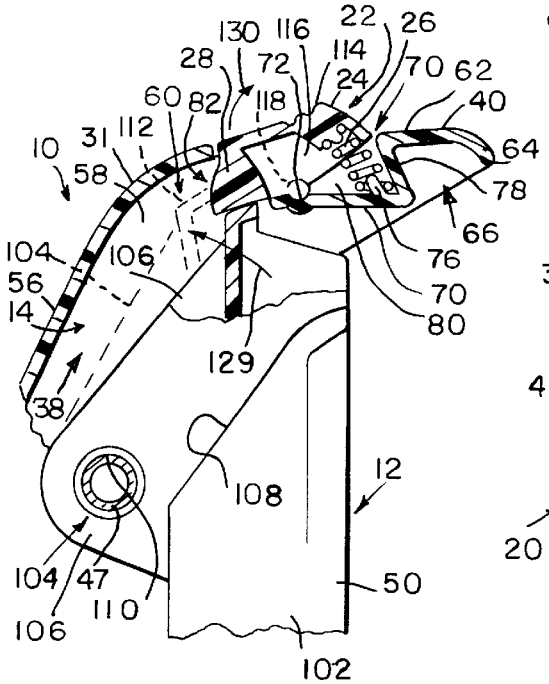
FIG. 9 is a view similar to FIG. 7 showing movement of the locking tab toward the front leg to cam the latch toward of the leg-release position.

To expand step stool 10 from collapsed position 33 to open position 23, the user must simply pivot rear leg 16 on front leg 14, as shown by arrow 129 in FIG. 9. Locking tab 112 presses catch 28 through aperture 82 and therefore pivots latch 22, as shown by arrow 130, toward leg-release position 122. Pivoting movement 129 continues until locking tab 112 has passed catch 28 and spring has biased latch 22 to normal-fastened position 120. At this time, as shown in FIG. 6, catch 28 engages locking tab 112, tab 94 of top step 18 engages ramped portion 55 of upper cross strut 52, and edge 108 engages front leg 14. Thus, rear leg 16 is fastened to front leg 14 to fasten frame 12 in opened position 23.

Although the invention has been described in detail with reference to preferred embodiments, variations and modifications exist within the scope and spirit of the invention as described and defined in the following claims.

What is claimed is:

1. A step stool comprising a frame including a front leg having opposite leg members, a handle portion extending between the leg members, and a step spaced-apart from the handle portion and a rear leg pivotably coupled to the front leg for movement of the frame between an opened position and a collapsed position, and a latch movably coupled to the handle portion and being formed to removably engage the rear leg to block movement of the frame from the opened position toward the collapsed position.

2. The step stool of claim 1, wherein the rear leg includes opposite rear leg members and a cross strut extending between the rear leg members and the cross strut supports the step when the frame is in the opened position.

3. The step stool of claim 2, wherein the step includes a step surface and a support panel extending from the step surface and the step surface faces the handle portion.

4. The step stool of claim 3, wherein the cross strut includes a support portion and the support panel engages the support portion when the frame is in the opened position.

5. The step stool of claim 4, wherein the support panel includes a tab and the cross strut includes a ramped portion and the tab engages the ramped portion when the frame is in the opened position.

6. The step stool of claim 3, wherein the support panel includes a tab and the cross strut includes a ramped portion and the tab engages the ramped portion when the frame is in the opened position.

7. The step stool of claim 6, wherein the tab of the support panel is spaced-apart from the cross strut when the frame is in the collapsed position.

8. The step stool of claim 2, wherein the cross strut and rear leg members define a space and the step extends through the space off-set from the cross strut when the frame is in the collapsed position.

9. The step stool of claim 2, wherein the front frame is formed from a plastic material.

10. The step stool of claim 1, wherein the rear leg includes opposite rear leg members each having an elbow pivotably coupled to the front leg and one of the elbows includes a locking tab positioned to lie between the front leg member and the latch when the frame is in the opened position.

11. The step stool of claim 10, wherein the handle portion is formed to include a cavity and the latch is mounted in the cavity for pivoting movement relative to the front leg.

12. The step stool of claim 11, wherein the cavity is defined by a floor and an end wall and a spring extends between the floor and the latch to bias the latch to a normal-fastened position.

13. The step stool of claim 12, wherein the latch includes a button and a catch and the button is biased through cavity away from the floor when the latch is in the normal-fastened position.

14. The step stool of claim 1, wherein the front leg is formed from a plastic material.

15. A step stool comprising a frame including a front leg having opposite leg members each with a lowermost bottom end and an uppermost top end, a handle portion extending between the uppermost top ends, and a step spaced-apart from the handle portion and a rear leg including opposite rear leg members each including a lowermost bottom end and an elbow pivotably coupled to the front leg for movement between an opened position in which the bottom end of the front leg is spaced apart from the bottom end of the rear leg and a collapsed position in which the front and rear legs are folded together, and a latch movably coupled to the handle portion of the front leg and being formed for engagement with one of the elbows when the frame is in the opened position.

16. The step stool of claim 15, wherein one of the elbows includes a locking tab and the locking tab is positioned to lie between the front leg member and the latch when the frame is in the opened position.

17. The step stool of claim 16, wherein the latch includes a button and a catch and the catch is biased normally toward the locking tab when the latch is in he normal-fastened position.

18. The step stool of claim 16, wherein the front leg is constructed of a plastic material.

19. The step stool of claim 15, wherein the rear leg includes a cross strut extending between the rear leg members and the cross strut supports the step when the frame is in the opened position.

20. A step stool comprising a frame including a front leg having opposite leg members, a handle portion extending between the leg members, and a step spaced-apart from the handle portion and a rear leg including opposite rear leg members pivotably coupled to the front leg for movement of the frame between an opened position and a collapsed position and a cross strut extending between the rear leg members to interconnect the rear leg members, the cross strut being formed to support the step when the frame is in the opened position, and a latch movably coupled to the front leg and being formed to engage one of the rear leg members to block movement of the frame from the opened position toward the collapsed position.

21. The step stool of claim 20, wherein the frame is constructed of a plastics material.

22. The step stool of claim 21, wherein the step includes a tab and the cross strut includes a ramped portion and the tab engages the ramped portion when the frame is in the opened position.

23. The step stool of claim 21, wherein the step includes a step surface and a support panel extending from the step surface and the support panel engages the cross strut when the frame is in the opened position.

24. The step stool of claim 20, wherein one of the rear leg members includes a locking tab and the latch engages the locking tab when the frame is in the opened position.

25. A step stool comprising a frame including a front leg, a handle portion coupled to the front leg, and a step spaced-apart from the handle portion and a rear leg pivotably coupled to the front leg for movement of the frame between an opened position and a collapsed position, the rear leg including opposite rear leg members and a cross strut coupled to the rear leg members, the cross strut including a support portion and a ramped portion and the step engages the support portion when the frame is in the opened position and engages the ramped portion when the frame is in the opened position, and a latch coupled to the handle portion and being formed to engage the rear leg to block movement of the frame from the opened position toward the collapsed position.

26. A step stool comprising a frame including a front leg, a handle portion coupled to the front leg, and a step spaced-apart from the handle portion and a rear leg pivotably coupled to the front leg for movement of the frame between an opened position and a collapsed position, the step including a step surface facing the handle portion, a support panel extending from the step surface, and a tab extending from the support panel, the rear leg including opposite rear leg members and a cross strut coupled to the rear leg members, the cross strut including a ramped portion and the tab engages the engages the ramped portion when the frame is in the opened position, and a latch coupled to the handle portion and being formed to engage the rear leg to block movement of the frame from the opened position toward the collapsed position.

27. A step stool comprising a frame including a front leg, a handle portion coupled to the front leg, and a step coupled to the front leg and a rear leg including opposite rear leg members pivotably coupled to the front leg for movement of the frame between an opened position and a collapsed position and a cross strut coupled to the rear leg members, the cross strut being formed to support the step when the frame is in the opened position and at least one of the rear leg members including a locking tab, and a latch movably coupled to the front leg and engaging the locking tab of at least one of the rear leg members to block movement of the frame from the opened position toward the collapsed position when the frame is in the opened position.

28. A step stool comprising a frame including a front leg having opposite leg members, a handle portion extending between the leg members, and a step spaced-apart from the handle portion and a rear leg pivotably coupled to the front leg for movement of the frame between an opened position and a collapsed position, and a latch movably coupled to the handle portion and being formed to engage the rear leg to block movement of the frame from the opened position toward the collapsed position, the rear leg including opposite rear leg members and a cross strut extending between the rear leg members and the cross strut supports the step when the frame is in the opened position, the step including a step surface and a support panel extending from the step surface and the step surface faces the handle portion, the cross strut including a support portion and the support panel engages the support portion when the frame is in the opened position, and the support panel including a tab and the cross strut includes a ramped portion and the tab engages the ramped portion when the frame is in the opened position.

29. A step stool comprising a frame including a front leg having opposite leg members, a handle portion extending between the leg members, and a step spaced-apart from the handle portion and a rear leg pivotably coupled to the front leg for movement of the frame between an opened position and a collapsed position, and a latch movably coupled to the handle portion and being formed to engage the rear leg to block movement of the frame from the opened position toward the collapsed position, the rear leg including opposite rear leg members and a cross strut extending between the rear leg members and the cross strut supports the step when the frame is in the opened position, the step including a step surface and a support panel extending from the step surface and the step surface faces the handle portion, and the support panel including a tab and the cross strut includes a ramped portion and the tab engages the ramped portion when the frame is in the opened position.

30. A step stool comprising a frame including a front leg having opposite leg members, a handle portion extending between the leg members, and a step spaced-apart from the handle portion and a rear leg including opposite rear leg members pivotably coupled to the front leg for movement of the frame between an opened position and a collapsed position and a cross strut extending between the rear leg members, the cross strut being formed to support the step when the frame is in the opened position, and a latch movably coupled to the front leg and being formed to engage one of the rear leg members to block movement of the frame from the opened position toward the collapsed position, the frame being constructed of a plastics material, and the step including a tab and the cross strut including a ramped portion and the tab engages the ramped portion when the frame is in the opened position.

31. A step stool comprising a frame including a front leg having opposite leg members, a handle portion extending between the leg members, and a step spaced-apart from the handle portion and a rear leg including opposite rear leg members pivotably coupled to the front leg for movement of the frame between an opened position and a collapsed position and a cross strut extending between the rear leg members, the cross strut being formed to support the step when the frame is in the opened position, and a latch movably coupled to the front leg and being formed to engage one of the rear leg members to block movement of the frame from the opened position toward the collapsed position, and one of the rear leg members including a locking tab and the latch engages the locking tab when the frame is in the opened position.

* * * * *